United States Patent [19]

Ariyama et al.

[11] 4,410,262

[45] Oct. 18, 1983

[54] SHEET TRANSPORTATION AND SEPARATION APPARATUS

[75] Inventors: Kenzo Ariyama, Yokohama; Akira Hirose, Tokyo; Tadashi Itoh, Yokohama, all of Japan

[73] Assignee: Ricoh Company, Ltd., Japan

[21] Appl. No.: 275,125

[22] Filed: Jun. 18, 1981

[30] Foreign Application Priority Data

Jun. 19, 1980 [JP] Japan ..... 55-083299
Jun. 25, 1980 [JP] Japan ..... 55-086082
Jun. 27, 1980 [JP] Japan ..... 55-087530

[51] Int. Cl.[3] ..... G03G 15/14; G03G 15/22

[52] U.S. Cl. ..... 355/3 SH; 271/307; 271/309; 271/312; 271/DIG. 2; 355/3 TR; 355/14 SH

[58] Field of Search ..... 355/3 R, 3 TR, 3 SH, 355/14 TR, 14 SH; 271/307, 308, 309, 310, 312, 313, DIG. 2

[56] References Cited

U.S. PATENT DOCUMENTS 3,450,402 6/1969 Weiler ..... 271/80
3,684,363 8/1972 Ito et al. ..... 355/3
3,687,539 8/1972 Furuichi ..... 355/3 R X
3,743,406 7/1973 Komori et al. ..... 355/8
3,820,776 6/1974 Fujimoto et al. ..... 271/80
3,912,256 10/1975 Nagahara ..... 271/174
3,926,429 12/1975 Satomi et al. ..... 271/174
3,955,889 5/1976 Ishiguro et al. ..... 355/3
4,000,942 1/1977 Ito et al. ..... 355/3
4,060,230 11/1977 Church et al. ..... 271/DIG. 2
4,061,330 12/1977 Yanagawa ..... 271/309
4,114,536 9/1978 Kaneko et al. ..... 101/426
4,269,504 5/1981 Landa ..... 355/3
4,278,341 7/1981 Burgess et al. ..... 355/3
4,327,991 5/1982 Takeuchi et al. ..... 271/308 X

FOREIGN PATENT DOCUMENTS 3032505 3/1981 Fed. Rep. of Germany ..... 271/312

*Primary Examiner*—Fred L. Braun
*Attorney, Agent, or Firm*—Guy W. Shoup; Gerald F. Dunne

[57] ABSTRACT

A sheet transportation and separation apparatus separates a sheet, which is moved in close contact with the surface of a member moving in synchronization with the sheet, from the surface of the moving member by deforming the corner of a leading edge of the sheet by a member operated by the edge of the sheet.

32 Claims, 25 Drawing Figures

SHEET TRANSPORTATION AND SEPARATION APPARATUS

BACKGROUND OF THE INVENTION

The present invention relates to a sheet transportation and separation apparatus. The sheet transportation and separation apparatus is used for separating a sheet, which is transported in close contact with the surface of a member moving in one direction, and is usually applied to image reproducing apparatuses such as copying machines and facsimile devices.

Such image reproducing apparatuses, for example electrophotographic copying systems of various types, using image transfer processes are, as is well-known, roughly classified into a visible image transfer type in which latent electrostatic images are formed on the surface of an image bearing member, for example, a photoconductor or a dielectric material, and the latent electrostatic images are then developed into visible images, which are thereafter transferred to an image transfer material; and an electrostatic latent image transfer type in which the latent electrostatic image formed on the surface of an image bearing member as mentioned above are transferred to an image transfer material having a dielectric surface, and then the transferred latent electrostatic images are developed into visible images.

In either type of image transfer mentioned above, the process of separating an imge transfer material from the image bearing member, which material is transported in uniform contact with the surface of the image bearing member is very important. Various types of image transfer material separation apparatuses with the above-mentioned function have been proposed and provided for practical use.

There is known a pick-off belt separation system which is one of the conventional image transfer material separation apparatuses. In this system, a pick-off belt made of a thin material is in contact with the peripheral surface of one side of an image bearing member, which can be in a drum or an endless belt shape. One side of the image transfer material, fed so as to be brought into close contact with the image bearing member, is caused to run over the above-mentioned pick-off belt, i.e., the pick-off belt is placed between the surface of the image bearing member and the image transfer material during the separation process. The pick-off belt extends parallel to the movement direction of the image bearing member and to the movement direction of the image transfer material. The opposite side ends of the pick-off belt are positioned away from the surface of the image bearing member.

Therefore, one side of the image transfer material is in close contact with the images formed on the surface of the image bearing member for image transfer, and the side portion rides on the pick-off belt from the beginning, and, with continuous transfer of the image transfer material, the image transfer material is moved away from the surface of the image bearing member.

This pick-off belt separation system can separate the image transfer material from the surface of the image bearing member without fail after image transfer, since one side portion of the image transfer material is separated from the surface of the image bearing member from the beginning by the pick-off belt. In this sense, the pick-off belt separation system is one of the best conventional image transfer material separation systems. However, that system has the following unavoidable shortcoming:

In the system, the one side portion of the image transfer material which rides onto the pick-off belt does not come into contact with the surface of the image bearing member, and therefore no images can be formed in the one side portion of the image transfer material, forming a blank portion in the transportation direction of the image transfer material.

In the pick-off belt system, this shortcoming is unavoidable, and when images exist in the very side portion of the original document, part of the images in the side portion cannot be duplicated. Stated differently, the side edge portion is the so-called dead space or pick-off margin, which is a big obstacle to increasing the effective image area on the image bearing member.

In order to remove the above-mentioned shortcoming, an image transfer material separation apparatus has been proposed in U.S. patent application Ser. No. 219,258 filed Dec. 22, 1980 which is a continuation-in-part of U.S. patent application Ser. No. 213,650 filed Dec. 5, 1980 now abandoned. This apparatus can guarantee the same performance as the conventional image transfer material separation apparatus employing the pick-off belt, and can maximize the effective image area on the image bearing member. In this systemm, a corner of the image transfer material in the leading edge side thereof is bent or curled so as to be separated from the surface of the image bearing member. Furthermore, a corner separator, which is substantially triangular in shape and has an image transfer material separation vertex, is positioned so as to be in light contact with or in close proximity with the surface of the image bearing member. The corner separator catches the above-mentioned folded or curled portion of the image transfer material and separates the transfer material from the surface of the image bearing member.

One of the significant shortcomings of this system is that an apparatus for folding the corner of the image transfer material in timed relation with the transportation of the transfer material is required. Such an apparatus is extremely complex in mechanism and expensive.

Furthermore, the above shortcoming is inevitable in devices such as a facsimile and an image reproducing apparatus employing a sheet transportation and separation apparatus, which separates a sheet closely contacted to the surface of a member moving in one direction.

SUMMARY OF THE INVENTION

It is a primary object of the present invention to provide a sheet transportation and separation apparatus, which is provided with an image transfer material corner folding apparatus and works without the need for any specific timing with other machine operations.

This object of the invention is accomplished by the following apparatus comprising a member to which a sheet is closely contacted, a sheet leading edge curling apparatus for curling the leading edge of the sheet so as to be away from the surface of the above-mentioned member, and a stripping means for stripping the sheet from the surface of the member by catching the curled portion of the sheet when the sheet except its curled portion is moved together with the member while in uniform contact with the member.

In this sheet transportation and separation apparatus, the sheet leading edge curling apparatus (simply referred to as the curling means hereinafter) is disposed in the sheet transportation path and comprises an elastic roller which is driven for rotation in the sheet transporting direction, a sheet corner pressure member which is rotatably supported, facing the elastic roller, so as to hold the sheet, and having a step portion against which the leading edge of the sheet strikes and which step portion is normally out of contact with the elastic roller, and a convex portion which is formed behind the step portion in the rotating direction thereof and which can be brought into pressure contact with the elastic roller, and a registration means for positioning the sheet corner pressure member at a home position where the step portion is projected to the transportation path while the convex portion is retracted from the transportation path, whereby when the sheet corner pressure member is at the home position, the leading edge of the sheet fed between the elastic roller and the convex portion strikes against the step portion and is rotated, and the convex portion, holding the sheet, is brought into pressure contact with the elastic roller, and when the convex portion is moved away from the elastic roller, the sheet corner pressure member is brought back to the home position with stepwise rotation.

According to the present invention, the leading edge of the sheet is curled in such a direction as to separate the sheet from the member (to which the sheet is contacted), and the stripping means is then acted upon the sheet, stripping the sheet from the member. Furthermore, when the sheet is separated from the member, it is not necessary to bring the stripping means into contact with the member. Therefore, it does not occur that the surface of the member is scratched by the stripping means.

In addition to the above-mentioned key feature, another feature of the invention is that it is not necessary to take into consideration the timing with respect to the sheet transportation and the operation of the curling means for curling the sheet edge. Stated differently, when the sheet fed toward the member (to which the sheet is contacted) by the sheet transportation means comes into contact with the curling means, the leading edge of the sheet is curled by the curling means as the sheet is being moved. In other words, it is not necessary to detect the movement of the sheet in order to curl the leading edge of the sheet. The invention aims at providing a device which can assure secure sheet separation in spite of its simple construction.

Another object of the invention is to provide a sheet transportation and separation apparatus provided with a sheet leading edge curling means which is mechanically simple.

This object of the invention can be attained by such a sheet transportation and separation apparatus, provided with a guide portion which is disposed in such a position, between the sheet transportation means and a member to which the sheet is contacted, where the movement of the leading edge of the sheet on a standard edge thereof is hindered, whereby a leading corner of the sheet is moved away from the surface of the member, and a sheet leading corner curling member for curling a leading corner of the sheet, which curling member includes an arc portion and is in the shape of letter U. In this apparatus, by disposing the U-shaped curling member in the path where the leading corner of the sheet is moved, a curl can be formed in a leading corner of the sheet. Therefore, this apparatus is extremely inexpensive.

When it is applied to an image reproducing apparatus such as a copying machine, the present invention can offer the following advantage: Since only a part of the leading edge of the sheet, used as a transfer material, is curled for sheet separation purpose, all the remaining area of the sheet except the curled area can be closely contacted to a member such as a photoconductor, so that the effective image area can be maximized.

DESCRIPTION OF THE PREFERRED EMBODIMENTS

Figure 1:
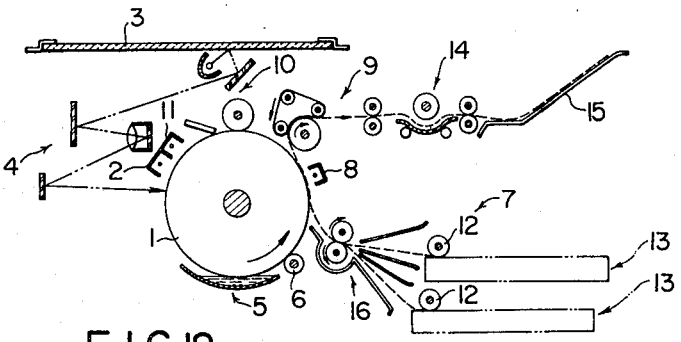
FIG. 1 is a diagrammatical view of an example of a copying machine to which the invention is applied.

FIG. 1 shows an example of an electrophotographic copying machine to which the invention is applied. In the copying machine as shown in FIG. 1, a drum-shaped photoconductor is employed. However, a beltshaped photoconductor can be employed as well in the copying machine to which the invention is applicable. As will become apparent from the following explanation, sheets of plain paper, cut to a predetermined size, are employed as the image transfer material in the copying machine, and therefore the image transfer material is referred to as the image transfer sheet hereinafter.

In FIG. 1, reference numeral 1 represents the photoconductor drum, which is rotated in the direction of the arrow. Around the photoconductor drum 1 are arranged a charger 2 for charging the surface of the drum 1 to a predetermined polarity, an exposure optical system 4 for forming a latent electrostatic image, corresponding to the image of an original document (not shown) placed on a contact glass, on the electrically charged surface of the drum 1, a development apparatus 5 for developing the latent electrostatic image, which in the present example is shown as a liquid type development apparatus, a squeezee roller 6 for regulating the thickness of a liquid developer remaining on the surface of the drum 1 after development, a sheet feeding apparatus 7 for feeding a transfer sheet 5 onto the surface of the drum 1 which bears the developed visible image, an image transfer charger 8 for applying corona charges with a polarity opposite to that of the visible image from the back side of the sheet S which is in close contact with the surface of the drum 1, a sheet transportation and separation apparatus 9 for separating the sheet S from the surface of the drum 1 after image transfer and transporting the sheet S in a direction away from the rotating direction of the drum 1, a cleaning apparatus 10 for cleaning the surface of the drum 1 after image transfer, and a quenching charger 11.

In the copying machine shown in FIG. 1, the sheet feeding apparatus 7 is provided with two sheet feeding cassettes 13, and the sheets are selectively fed from one of the two cassettes by sheet feeding rollers 12. The sheet fed from the cassettes 13 is transported so that the leading edge of the sheet comes into contact with a pair of registration rollers 16 which are not rotated at that moment. Thereafter, the registration rollers 16 are rotated, so that the sheet is then transported by the rollers 16, with the leading edge thereof directed to the surface of the drum 1. The leading edge of the sheet timely meets the leading edge of a visible image formed on the surface of the drum 1. Thereafter, the sheet S is moved together with the drum while in close contact with the drum surface, so that the visible image is transferred to the sheet by the image transfer charger.

After image transfer, the sheet is directed in such a direction as to be moved away from the surface of the drum 1 by a sheet separation member, which will be described in detail later. Thereafter, the sheet is transported to an image fixing apparatus 14 by a sheet transportation and separation apparatus 9. The sheet is then discharged onto a copy tray 15.

Figure 2:
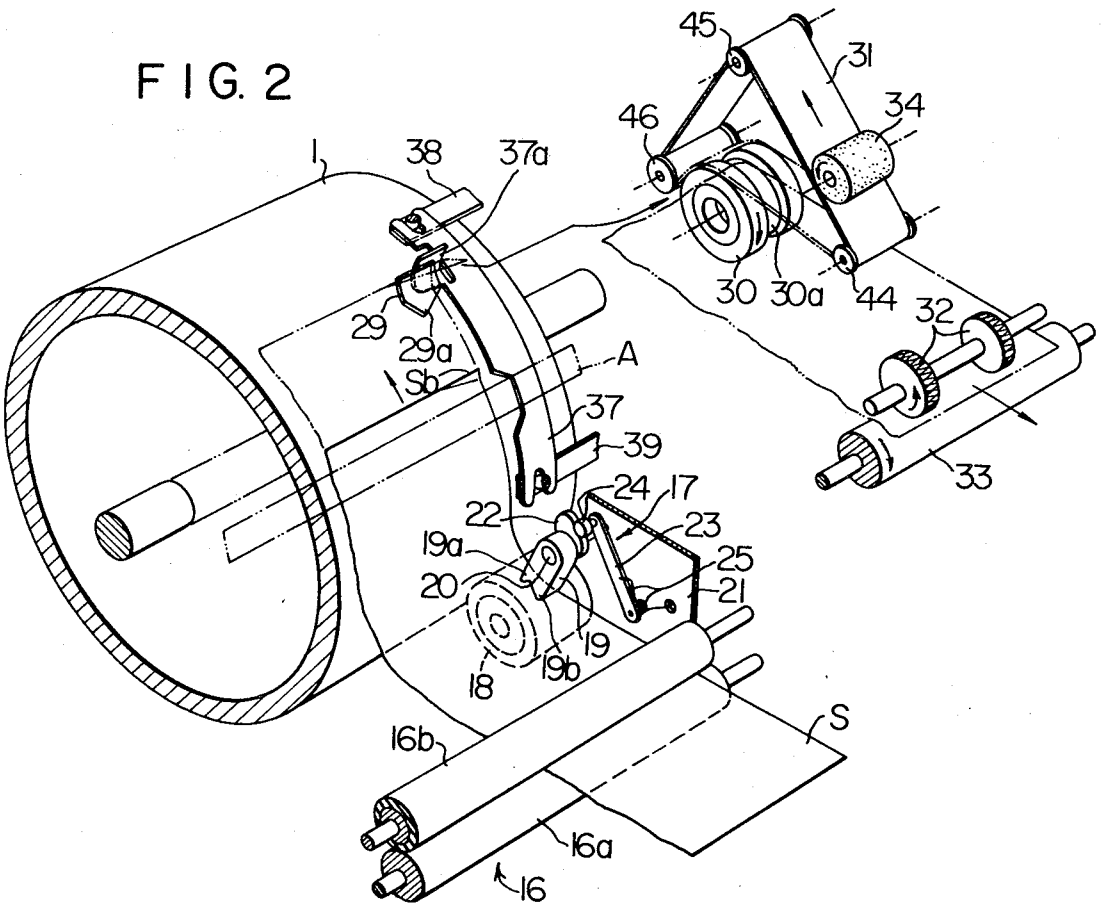
FIG. 2 is a perspective view of an embodiment of sheet transportation and separation apparatus according to the invention.

Referring to FIG. 2, a sheet leading edge bending apparatus 17 (referred to as the bending apparatus 17 hereinafter) is disposed in the sheet transportation path between the drum 1 and the registration rollers 16 for transporting the sheet S held therebetween in the direction towards the drum 1.

The bending apparatus 17 comprises an elastic roller 18 made of an elastic material such as soft rubber or sponge rubber and which is driven for rotation in the sheet transportation direction, and a pressure application member 19 disposed so as to face the elastic roller for applying pressure to the leading edge of the sheet, with the sheet S held between the pressure application apparatus 19 and the elastic roller 18.

Figure 4:
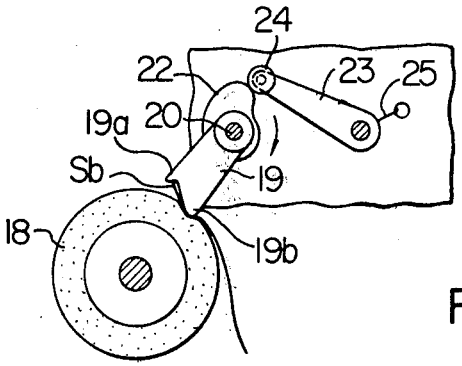
FIG. 4 is an explanatory view of the operation of the curling means in FIG. 3.

The pressure application member 19 is fixed to a support shaft 20 which is rotatably supported by a side plate 21 to rotate in the direction of the arrow shown in FIG. 4. To the support shaft 20 is fixed a cam 22 which will be described later.

A lever 23 is disposed, with its lower base portion being fixed to the side plate 21 and with its free end attached to a rotatable roller 24. Normally the lever 23 is urged downwardly by a spring 25 so that the roller 24 can be rotated in pressure contact with the inclined surface of the cam 22.

The pressure application member 19 includes a boot-shaped side surface with its toe side directed towards the upstream side surface with respect to the rotation thereof, and a step portion **19*a*** which corresponds to the heel of the boot-shaped side surface.

When the pressure application member 19 is rotated about the support shaft 20, the step portion **19*a* is not long enough to come into contact with the elastic roller 18, while a convex portion 19*b* of the pressure application member 19 is long enough to come into pressure contact with the surface of the elastic roller 18**.

Figure 3:
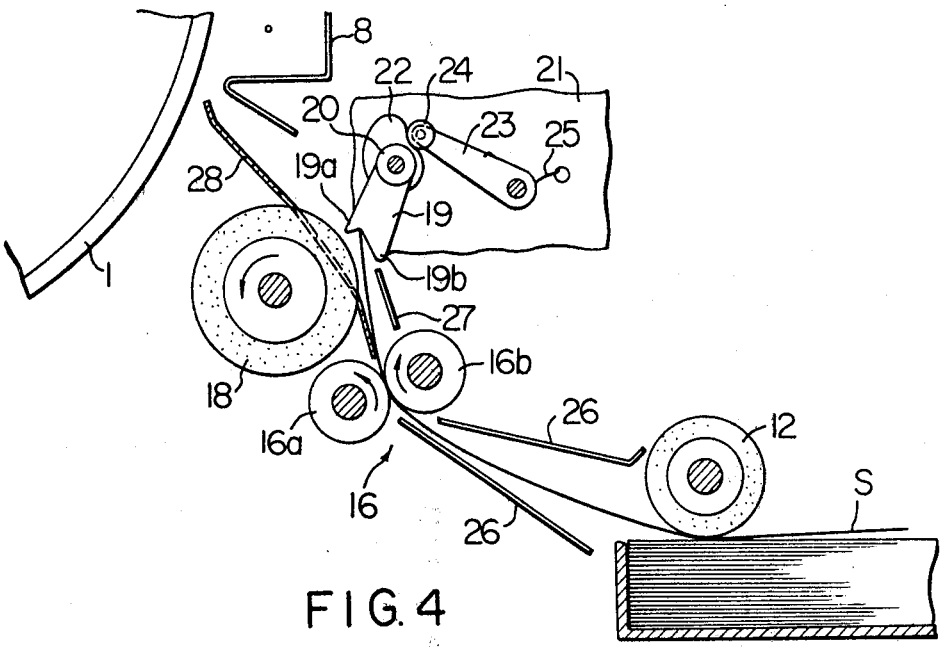
FIG. 3 is a diagrammatical front view of the main part of the embodiment in FIG. 2, including an example of a sheet leading edge curling means.

When the pressure application member 19 is at its home position as shown in FIG. 3, it is positioned away from the elastic roller 18, and the step portion **19*a* is in the transportation path for the sheet S and the convex portion 19*b*** is retracted from the transportation path.

The cam 22 is not symmetrically in shape and may be generally characterized as being in the shape of an egg with a portion of its one side removed therefrom to form a concave portion therein. The cam 22 forms an inclined surface elevating from the lowest position to the highest position at the rotation angle where the step portion **19*a* of the pressure application member 19 is moved as it comes into contact with the sheet and the convex portion 19*b* is brought into pressure contact with the surface of the elastic roller 18, and the pressure application member 19 is moved together with the elastic roller 18. The cam 22 forms an inclined surface descending from the highest position to the lowest position at the rotation angle where the convex portion 19*b* is moved away from the surface of the elastic roller 18** and returned to its original position.

Referring back to FIG. 2, a fixed blade 37 made of an elastic material is disposed along the peripheral surface of the drum 1 at the peripheral end surface thereof. The opposite ends of the fixed blade 37 are each attached to hanger brackets 38 and 39. To the inner side of a curved guide piece **37*a* formed in the blade 37 is fixed a stripping pawl 29. The stripping pawl 29 is for stripping the sheet from the surface of the drum 1 as will be explained in detail and is curved along the guide piece 37*a* and is in the shape of a triangle with a stripping end 29*a* as one of the vertexes of the triangle. The stripping end 29*a* is in light contact with or in close proximity with the surface of the drum 1**.

Figure 10:
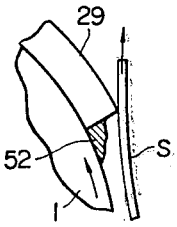
FIG. 10 is an enlarged view of the relationship between the sheet stripping member, photoconductor and sheet.

As shown in FIG. 10, the stripping end can be made as a step and thus does not present a smooth transition from the drum surface. In this case, the stripping end serves to protect the image area of the sheet from being stained with toner or standing liquid developer 52.

Figure 11:
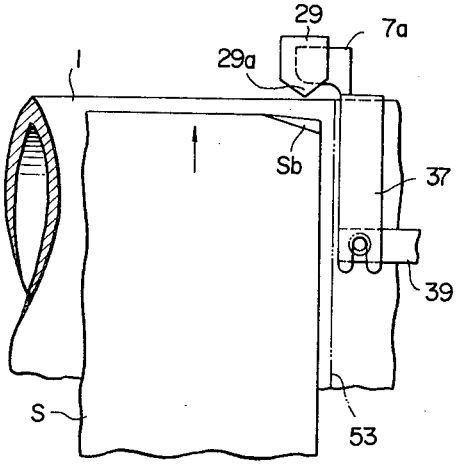
FIG. 11 is a diagrammatical side view showing the configuration of the photoconductor, sheet stripping member and sheet.

Referring to FIG. 11, th imaginary line 53 indicates the border line between a photoconductive area and a non-conductive area in the drum 1. In FIG. 11, the left side area is the photoconductive area where images can be formed and the right side area is the non-photoconductive area. The fixed blade 37 for attaching the stripping pawl 29 is disposed in the non-photoconductive area.

Figure 7:
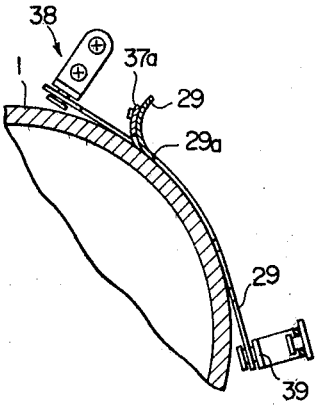
FIG. 7 is a diagrammatical front view of an example of a sheet stripping means.

Referring to FIG. 7, it is assumed that the stripping end 29*a* of the stripping pawl 29 is in light contact with the peripheral surface of the drum 1. In this case, when the stripping pawl 29 is designed so that the stripping end comes into contact with the surface of the drum 1 only when the sheet stripping is performed, the abrasion of the photoconductive area can be reduced in comparison with a stripping pawl which is designed so as to be always in contact with the surface of the drum 1.

Figure 8:
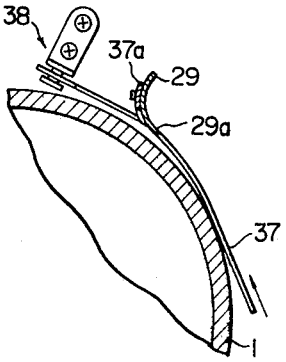
FIG. 8 is a diagrammatical front view of another example of a sheet stripping means.

One end of the fixed blade 37 made of an elastic plate, on the side of the bracket 38, is made so as to be swingably supported, while the other end of the fixed blade 37 on the side of the bracket 39 is made a free end. This free end is moved in the direction of the arrow as shown in FIG. 8, so that the blade 37 is bent, and the free end is then released, whereby the stripping end 29*a* of the stripping pawl 29 can be brought into contact with and away from the surface of the drum 1 as desired.

The above-mentioned attachment and detachment are performed, for instance, by use of a cam or the like, when the drum 1 or the image transfer charger (its reference numeral 8 in FIG. 1) is attached or detached before or after image transfer. Furthermore, the stripping pawl 29 and the fixed blade 37 can be made integrally.

Referring to FIGS. 2 and 3, the sheet S fed from one of the cassettes 13 (FIG. 1) is in a standby state while inserted into the contact portion between the registration rollers 16*a*, 16*b* along a guide plate 26. At a predetermined time, the rollers 16*a*, 16*b* are each rotated in the directions of the arrows, so that the sheet S is transported towards the drum 1, while held between the rollers 16*a*, 16*b* and guided by guide plates 27, 28. The sheet S is inserted into the gap between the elastic roller 18 and the pressure application member 19 which are disposed in the sheet transportation path. One side portion (a corner portion of the leading edge of the sheet S comes into contact with the step portion 19*a*. The sheet S is further transported, and therefore the pressure application member 19 is rotated clockwise in FIGS. 2 and 3.

Figure 5:
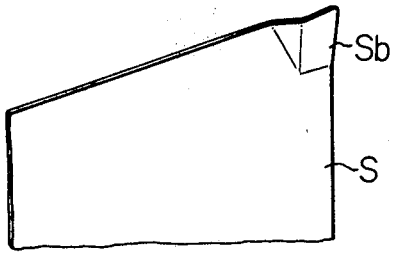
FIG. 5 is a perspective view of a sheet with a curl formed by the curling means.

When the pressure application member 19 is rotated clockwise, the convex portion 19*b* is brought into pressure contact with the surface of the elastic roller 18 with the sheet S held therebetween. As a result, leading edge corner Sb of the sheet S is bent in a rectangular shape as shown in FIG. 5. The elastic roller 18 is designed so as to be rotated at the same peripheral speed as the transportation speed of the sheet S at this moment, and the sheet is bent without fail when the pressure application member 19 is brought into pressure contact with the surface of the elastic roller 18. Therefore, unnecessary stress is not applied to the sheet S, and the sheet S is neither wrinkled nor deformed.

When the convex portion 19*b* is moved away from the elastic roller 18, with a further transportation of the sheet S, the roller 24 passes over the top portion of cam 22 and goes downwards since the cam 22 is rotated together with the pressure application member 19. The roller 24 is always urged by the spring 25 through the lever 23 so as to be brought into pressure contact with the inclined surface of the cam 22. Therefore, the cam 22 is rapidly rotated clockwise (FIG. 4), and the pressue application member 19 is returned to its home position (the position shown in FIG. 3) and is moved away from the elastic roller 18. On the other hand, the rollers 16*a*, 16*b* are continuously rotated, so that the sheet S with the bent portion Sb is fed towards the drum 1.

Thereafter, the sheet S is moved together with the drum 1, while in contact with the surface of the drum 1. Thereafter, the visible image on the drum 1 is transferred to the sheet S in the image transfer area A. At this moment, since the bent portion Sb is separated from the surface of the drum 1, no images are transferred to the bent portion Sb.

After image transfer, the sheet S is further transported and the its bent portion Sb passes over the stripping end 29*d* of the pawl 29, so that the portion of the sheet S, which has been in close contact with the surface of the drum 1, following the bent portion Sb, is scooped up by the stripping end 29*a*. Stated differently, the stripping pawl 29 catches a corner of the sheet S, which corner has been bent upwardly, and then strips the sheet S from the surface of the drum 1.

As described above, the sheet transportation and separation apparatus according to the invention comprises the sheet leading edge bending apparatus 17 including the pressure application member 19 and the elastic roller 18, and the sheet stripping member such as the stripping pawl 29. In this apparatus, only the leading edge corner of the sheet S (in the embodiment shown in the so far mentioned drawing figures) is bent so as to be moved from the surface of the drum 1 by the bending apparatus 17. After image transfer, the bent corner edge is caught by the sheet stripping apparatus, whereby the sheet S is stripped from the surface of the drum 1.

Therefore, in comparison with the conventional sheet stripping apparatus employing the pick-off belt, the effective image area can be maximized in the apparatus according to the present invention. This is because, in the invention, it is not necessary to move a side end portion of the sheet entirely in the longitudinal direction thereof away from the drum 1. Furthermore, the non-image transfer area is limited to the bent leading corner of the sheet S. This corner is used as a clue portion for separation of the sheet S from the surface of the drum 1, and therefore it can be extremely small. For this reason, the effective image area can be maximized, and the probability that any images exist in the bent leading corner is extremely small, and the formation of non-copy areas can be maximized.

Furthermore, it is not necessary to set a particular timing with respect to the transportation of the sheet and the bending of its corner by the bending apparatus. Therefore, the sheet stripping apparatus according to the invention is very mechanically simple and inexpensive.

When the stripping pawl is employed as the sheet stripping member, the stripping end of the stripping pawl is in light contact with or positioned in close proximity with the surface of the drum 1. Therefore, it does not occur that the sheet stripping member scratches the surface of the drum 1, and the stripping of the sheet can be performed securely.

In the electrophotographic copying apparatus, the sheet feeding systems employing sheet feeding cassettes can be roughly classified into two categories. The first category is of a one-side standard method and the second category is of a center standard method. In the former, the sheets with different sizes are fed parallel to the sheet transporting direction, using one side of the sheets.

Referring to FIG. 2, the above-mentioned one side of the sheets is placed on the side of the elastic roller 18 and the pressure application member 19, and the sheets are transported by the rollers 16*a*, 16*b*. In this case, even if the sizes of the sheets are different, the size and location of the bent portion Sb can be made constant.

The embodiment of a sheet stripping apparatus according to the invention is not limited to the one-side standard system, but can be applied to the center standard system. In the center standard system, the bending apparatus 17 is not disposed on one side of the sheet transportation path, but in the central portion of the sheet transportation path in terms of the sheet travelling direction.

Referring to FIG. 2, the stripping pawl 29 is a member which acts as a clue member for stripping the sheet from the drum 1. In this case, when the sheet is caused to move upwards by the guiding action of the stripping pawl 29 in the area from its bent portion Sb through its rear end, the sheet is transported while it is turned in the direction opposite to the rotation of the drum 1, whereby the stripping area of the sheet can be extended in the full transverse direction of the sheet in the leading edge area thereof. Stated differently, the sheet can be stripped from the surface of the drum by forcibly separating the bent portion Sb and extending the separating area to the opposite corner of the sheet.

The peripheral surface of layer of a turn roller 30 is made of rubber. A turn belt 31 which is in contact with the turn roller 30 is driven for rotation in the direction of the arrow, following the rotation of the turn roller 30. Furthermore, the turn roller 30 is rotated in synchronization with the rotation of the drum 1.

Figure 12:
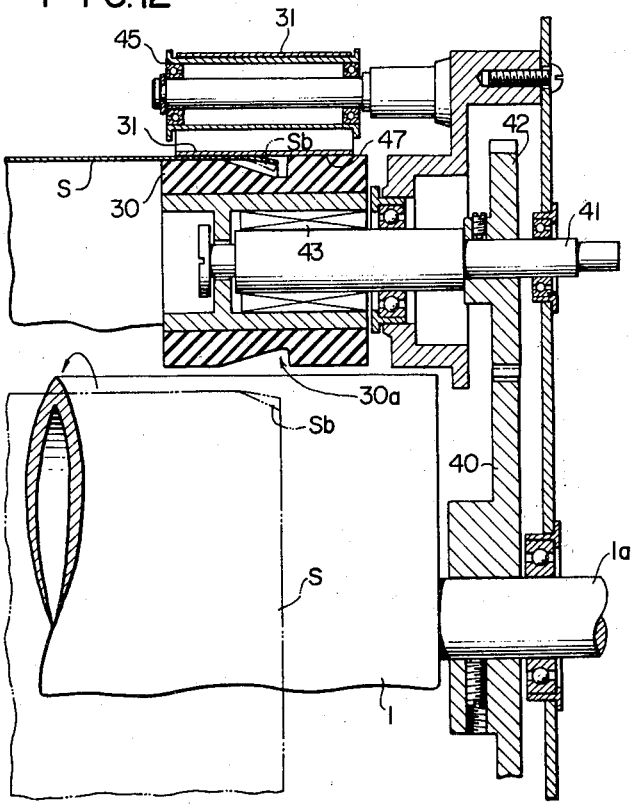
FIG. 12 is a sectional side view of an example of a sheet transportation means for transporting the sheet stripped from the photoconductor.

As shown in FIG. 12, a gear 40 is secured to a shaft 1*a* of the drum 1. The gear 40 engages a gear 42 secured to a shaft 41 of the turn roller 30.

When the drum 1 is rotated in the direction of the arrow, the turn roller 30 is rotated in the direction of the arrow as shown in FIG. 2, in synchronization with the rotation of the drum 1, through the gear 40, gear 42 and one-way clutch 43. The turn belt 31 is trained over three belt rollers 44, 45 and 46, and is rotated in the direction of the arrow.

As shown in FIGS. 2 and 12, a tapered circumferential groove 30*a* is formed in the turn roller 30 at a position where the bent leading corner Sb of the sheet passes, whereby the folding of the sheet in a dog-eared portion thereof can be prevented, and at the same time insertion of the sheet between the turn belt 31 and turn roller 30 is facilitated.

Referring to FIGS. 2 and 12, when the sheet S is transported, while held between the turn roller 30 and turn belt 31, the turn roller 30 and turn belt 31 are partly in contact with each other. This construction has the following advantages: In this case, the image area of the sheet comes into contact with the turn belt 31. However, in order to prevent the image from being transferred to the turn belt 31, the turn belt 31 is made of an offset preventing material such as Teflon. The coefficient of friction of such offset preventing material is so low that if the sheet exists in the entire contact area between the turn roller 30 and turn belt 31, the sheet and turn belt 30 slip on each other, causing friction of the image or stopping the rotation of the turn belt 31. This drawback can be eliminated by forming a mutual contact portion 47 as shown in FIG. 12 which can prevent the occurence of the above-mentioned inconvenience during the transportation of the sheet held between the turn roller 30 and turn belt 31.

The turn roller 30 and turn belt 31 can catch the bent corner of the sheet, transport the sheet in the direction opposite to the rotation of the drum 1, and cause the transfer rollers 32 and 33 to catch the sheet therebetween.

Thereafter, the sheet is transported to the image fixing apparatus 14 as shown in FIG. 1 and is then discharged onto a copy tray 15.

Figure 9:
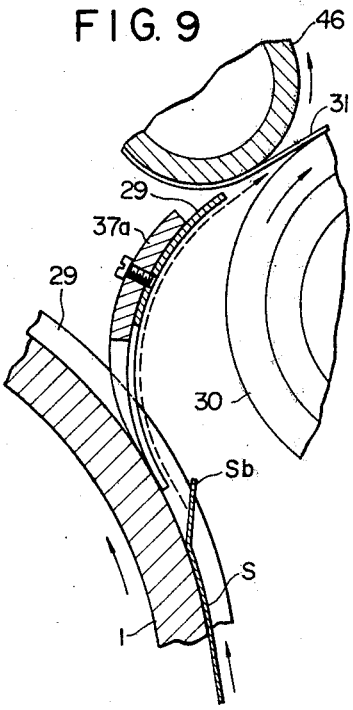
FIG. 9 is an explanatory enlarged front view of a state where the sheet is stripped from the photoconductor.

FIG. 9 is an enlarged view of the state in which the sheet is stripped from the surface of the drum 1 by the stripping pawl 29, and, at the same time, is caught between the turn roller 30 and turn belt 31 as it is guided by the stripping pawl 29.

Thus, by causing the turn roller 30 and turn belt 31 to catch a side edge portion of the sheet therebetween, the sheet stripping area can be extended to the entire leading edge in the transverse direction thereof. Thereafter, the sheet can be continuously stripped from the surface of the drum 1 in the direction towards the rear end of the sheet.

When the transportation speed of the sheet transported by the turn roller 30 and turn belt 31 is set so as to be slightly greater than the rotation speed of the drum 1, the image area of the sheet does not continuously come into contact with the stripping pawl 29, and therefore there is no risk that the images on the sheet are damaged by the stripping pawl 29.

It may occur that dust or toner is deposited on the surface of the turn belt 31. When this takes place, such dust or toner will degrade the image on the sheet or decrease the transportation force of the turn roller 30 and turn belt 31, or the turn roller 30 and turn belt 31 will slip on each other.

The above-mentioned drawback can be eliminated by disposing a cleaning member such as a cleaning roller 34 on the surface of the turn belt 31, as shown in FIG. 2, in order to remove such dust or toner from the surface of the belt 31. A fur brush or a rubber blade can be employed as the cleaning member. In addition to this, it may occur that toner or liquid developer is deposited on the peripheral surface of the turn roller 30. Such an inconvenience can be eliminated by disposing a cleaning member which is in contact with the turn roller 30.

Figure 6:
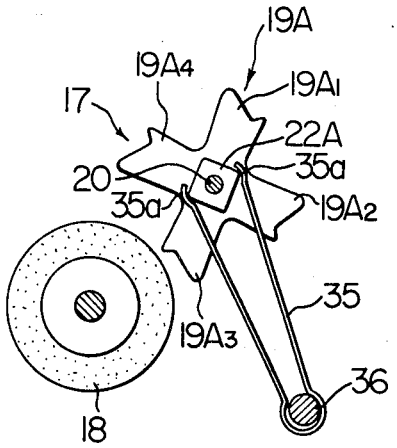
FIG. 6 is a diagrammatical front view of another example of the curling means.

Referring to FIG. 6, there is shown another embodiment of the present invention. In this embodiment, a pressure application member 19A, corresponding to the pressure application member 19 in the first embodiment, comprises four submembers which are disposed crosswise. The pressure application member 19A is secured to the shaft 20, to which is attached a rectangular cam 22A. A free end of a U-shaped spring 35 holds the corners on a diagonal line of the cam 22A so as to be in pressure contact with the corners, and a base portion of the spring 35 is loosely supported by a shaft 36 of the pressure application member 19A. An advantage of this embodiment is that the home position of the adjacent submember exsists at every 90 degrees in terms of the rotation angle. Therefore, the shape of the cam 22A is simple, and the desired function can be performed by forming the free end portion 35*a* of the U-shaped spring 35 in an arc shape, without requiring any rollers.

According to the invention, separation of the sheet from the surface of the drum 1 can be securely performed, and all the portions, except the corner, of the sheet can be employed as the effective image area, so that the effective area is maximized. At the same time, it is not necessary to set a particular timing with respect to the transportation of the sheet in connection with the separation thereof from the surface of the drum 1. Accordingly, the apparatus of the invention is mechanically simple. Furthermore, the sheet stripping member such as the stripping pawl can be disposed with reduced contact pressure against the surface of the drum 1, thereby preventing the surface of the drum 1 from being damaged or scratched by the sheet stripping member.

Another example of a bending apparatus for use in the present invention will now be explained. This bending apparatus is capable of curling a corner of the sheet. More specifically, referring to FIG. 13, the rollers 16*a*, 16*b* for transporting the sheet S towards the drum 1 are respectively driven for rotation in the directions of the arrows. A side portion with a width W on the standard side edge SA of the sheet S is a portion which is not engaged by the rollers 16*a*, 16*b*. In this portion, a hook portion of the bending member engages the sheet S.

The leading corner bending member is fixed to a side wall 21 on the standard side edge SA, which leading corner bending member comprises a bracket 49 which is attached to the side wall 21 through screws 48 in such a manner that the advance of the leading edge on the standard side edge of the sheet is hindered, and a hook member 51 which is attached to a bracket 49 through screws 50 in such a manner that the position of the hook member 51 is adjustable.

Figure 14:
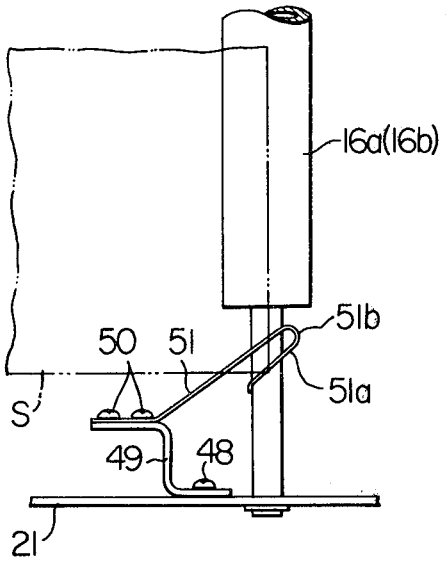
FIG. 14 is a plan view of the curling means shown in FIG. 13.
Figure 15:
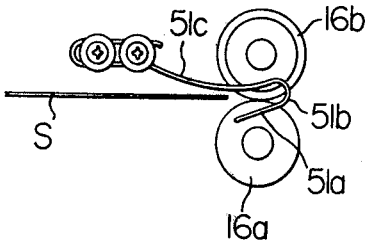
FIG. 15 is a front view of the curling means shown in FIG. 13.

As shown in FIGS. 14 and 15, the hook member 51 comprises a guide portion 15*a* for pushing upwards a leading edge of the sheet S from the back side thereof, an arc portion 51*b* for bending the leading edge pushed upwards, and a base portion 51*c* which is attached to the bracket 49 through the screws 50. The arc portion 51*b* is disposed closer to the drum 1 than the nipping portion between the rollers 16*a*, 16*b*.

The sheet S fed from one of the cassettes 13 (FIG. 1) is inserted into the mutual contact portion between the rollers 16*a*, 16*b*. Under this condition, the sheet S is caused to be on standby. At a predetermined time, the rollers 16*a*, 16*b* are each rotated in the directions of the arrows, whereby the transportation of the sheet S is performed.

Figure 16:
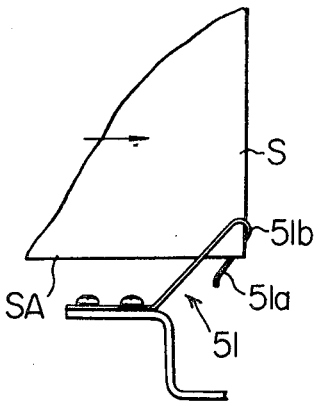
FIGS. 16 to 19 are explanatory views showing the process of forming a curl in the sheet.
Figure 17:
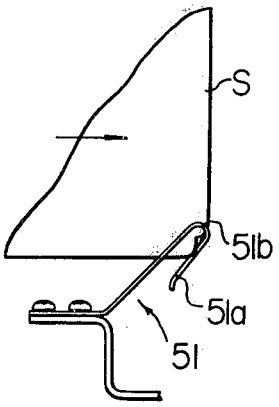

At this moment, the leading edge corner of the sheet S on the standard edge side thereof is first caught by the guide portion 51*a* of the hook member 51, and the back side of the sheet S is pushed upwards by the guide portion 51*a* as shown in FIG. 16. This is a preliminary step before bending the leading corner of the sheet S in such a manner as to be moved away from the surface of the drum 1. With a further transportation of the sheet S in the direction of the arrow, the corner of the sheet S is caused to rise along the arc portion 51*b*, so that the corner is bent as shown in FIG. 17.

Figure 18:
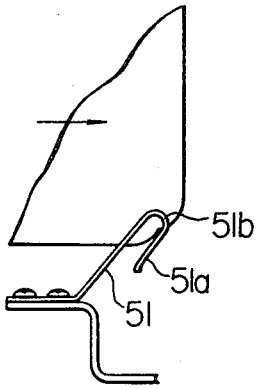

With a still further transportation of the sheet S, frictional pressure applied to the bent corner of the sheet S by the guide portion 51*a* of the hook member 51 as shown in FIG. 18, so that a dog-eared portion Sb is formed in the sheet S, and the sheet S is transported towards the drum 1.

Figure 13:
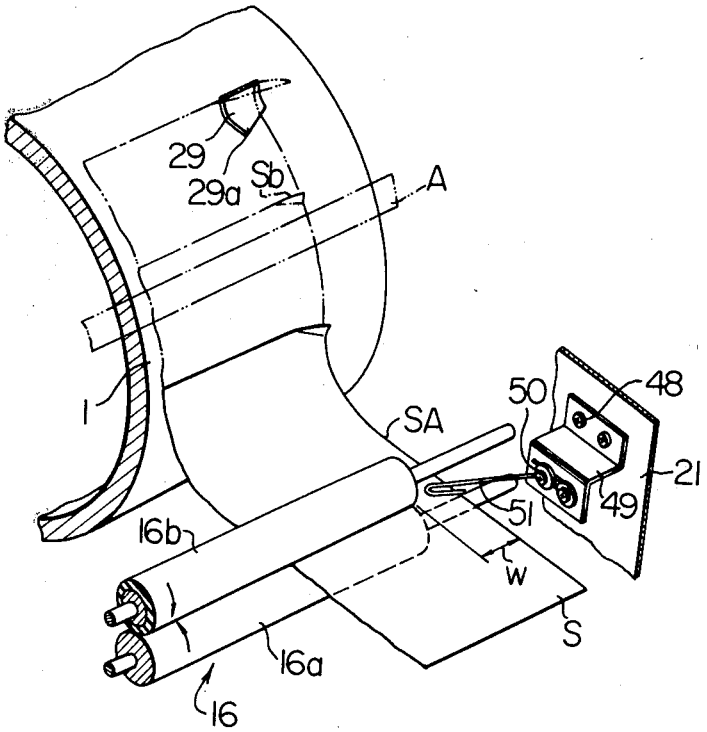
FIG. 13 is a perspective view of another example of a curling means.

Referring to FIG. 13, the sheet S is moved in contact with the surface of the drum 1. In the image transfer area A, the visible image formed on the drum 1 is transferred to the sheet S. At this moment, since the bent portion Sb is stripped from the surface of the drum 1, it is a non-image transfer portion. After image transfer, the sheet S is continuously transported, and its bent portion Sb passes over the stripping end of the stripping pawl 29. Thereafter, the portion of the sheet behind the dog-eared portion Sb is scooped up by the stripping end 29*a*.

In the above-described embodiment, there are provided the bending member including the hook portion 51 comprising the guide portion and arc portion, and the sheet stripping member such as the stripping pawl 29. Prior to image transfer, the leading corner of the sheet is bent so as to be stripped from the surface of the drum 1. At the same time, the sheet stripping member catches the bent leading corner of the sheet S and strips the sheet S from the surface of the drum 1.

A further example of a sheet separation means for separating the sheet from the surface of the drum 1 and a further example of a sheet corner bending means for use in the present invention will be explained.

Figure 20:
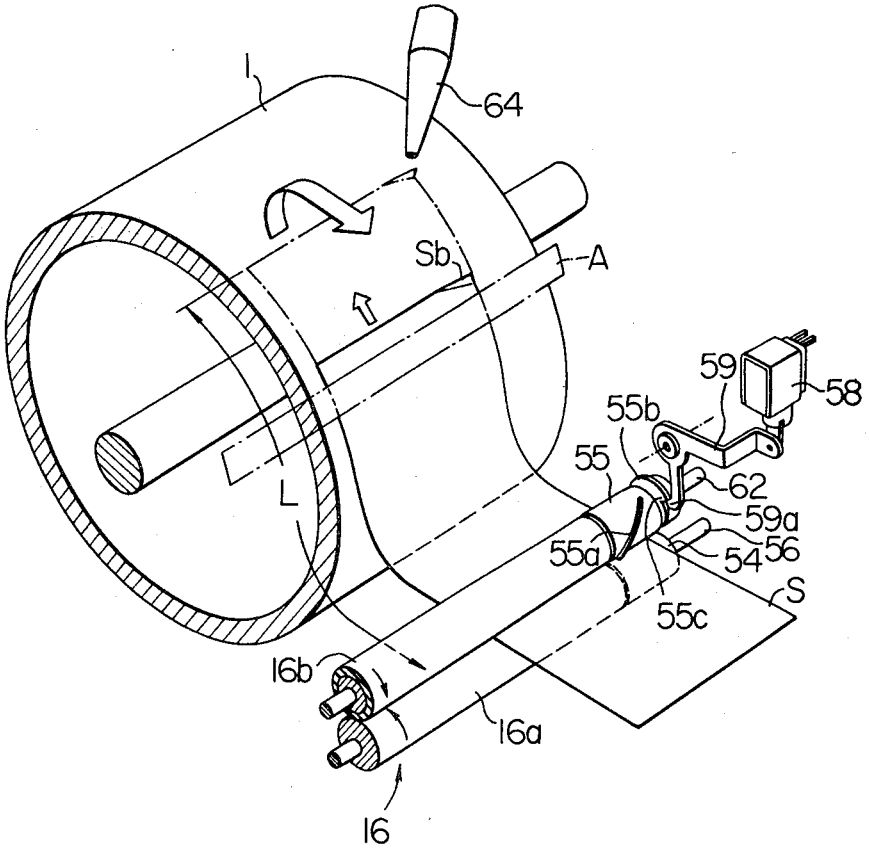
FIG. 20 is a perspective view of further examples of a curling means and sheet stripping means.
Figure 19:
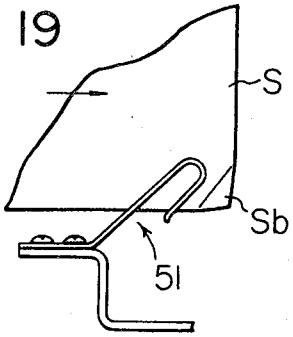

Referring to FIG. 20, an elastic roller 54 and a bending blade roller 55 are disposed on one end side of a shaft of the roller 16*a*, 16*b* for transporting the sheet S towards the drum 1. The elastic roller 54 is made of an elastic material such as soft rubber or sponge rubber. The elastic roller 54 is rotatable through a bearing 57 on a shaft 56 to which the roller 16*a* is secured. In other words, the elastic roller 54 is rotatable on the shaft 56.

On the peripheral surface of the bending blade roller 55 is formed a spiral bending blade 55*a*. The bending blade roller 55 serves as the so-called sleeve of a spring clutch mechanism. An engagement projection 59*a* of an engagement lever 59, which is connected to a solenoid 58, engages a step portion 55*c* formed in a flange 55*c* of the bending blade roller 55.

Figure 22:
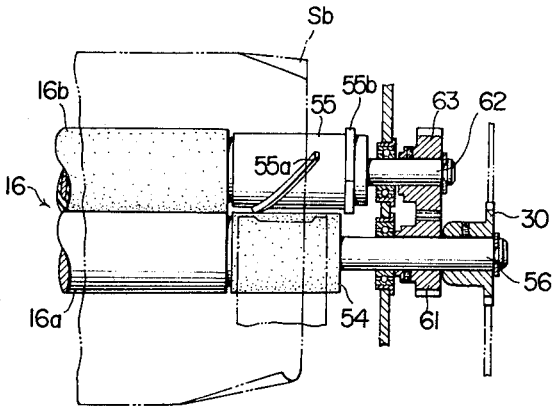
FIG. 22 is a diagrammatical side view of a further example of a curling means.

A driving system for the registration rollers 16 comprises a power input sprocket 60, a gear 61 and a gear 63 fixed to a shaft 62*a* of the roller 16*b* as shown in FIG. 22. As shown in FIG. 20, the registration rollers 16 are driven for rotation in the direction of the arrows.

Figure 21:
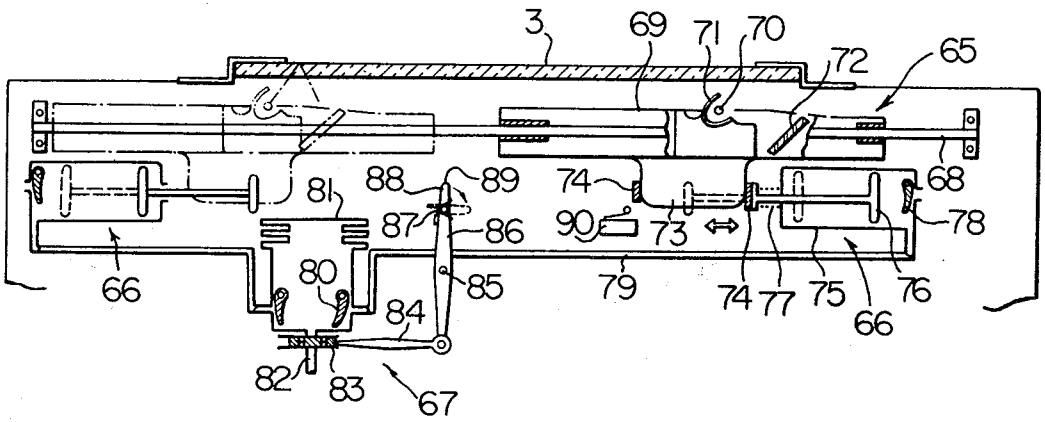
FIG. 21 is a schematic view of an air supply means for supplying air to the sheet stripping means.

To the peripheral edge side of the drum 1 is secured a separation nozzle 64 through a member (not shown) as shown in FIG. 20. As will be explained later, the separation nozzle 64 is a device for separating the sheet S from the surface of the drum 1 and is in the shape of a thin tube. The top end of the nozzle 64 is disposed in close proximity to the surface of the drum 1. As shown in FIG. 21, the nozzle 64 is connected to a compressed air generation apparatus.

Referring to FIG. 21, the compressed air generation apparatus comprises an optical scanner portion 65, two pump apparatuses 66 to which power is applied from the optical scanner portion 65, and a control valve apparatus 67 for discharging compressed air from the pump apparatus 66 at a predetermined time.

To the lower side of the opposite sides in the scanning direction of a contact glass 3 are fixed two guide rods, one of which is shown in FIG. 21. A scanner 69 is reciprocally supported by the guide rods 68.

On the scanner 69 are mounted a lamp 70 for illuminating the original document, and optical members such as a reflector 71 and a first mirror 72. Under the scanner 69, there is fixedly mounted a plate cam 73. Cushions 74 made of sponge rubber or the like are attached to the front and rear sides of the plate cam 73 in terms of the movement direction thereof.

Near the opposite dead points of the scanner 69 in the reciprocal path thereof are disposed pump apparatuses 66. The pump apparatus 66 comprises a cylinder 75, a piston 76, a spring 77, an inlet valve 78, an outlet tube 79, an outlet valve 80 and an accumulator 81. Usually, the piston 76 is urged so as to be positioned at its bottom dead center. By the piston 76, air in the copying machine is sucked into the cylinder 75 through the suction valve 78, and the sucked air is accumulated in the accumulator 81 through the outlet tube 79 and outlet valve 80.

When the scanner 69 is at its home position shown in FIG. 21, the piston 76 in the pump apparatus 66 on the right in FIG. 21 is positioned at its top dead center (shown by the solid line) through the plate cam 73. When the scanner 69 is moved to the left in FIG. 21 for performing scanning, the piston 76 is positioned at its bottom center (shown by the chain line), so that air is supplied from outside into the cylinder. When the scanner 69 comes to the position shown by the chain line upon termination of the scanning, the piston in the pump apparatus 66 on the left in FIG. 21 is positioned at its top dead center (shown by the solid line), so that air in the cylinder is accumulated in the accumulator 81.

The control valve apparatus 67 comprises a control valve 83 for opening and closing an outlet tube 82 of the accumulator 81, a first lever 84 connected to one end of the control valve 83, a second lever 86 which is connected to the other end of the first lever 84 and is rotatably supported by a fixed support shaft 85, and a third lever 88, one of which is rotatably supported by the other end of the second lever 88. These levers are normally urged so as to close the outlet tube 82. The third lever 88 is normally urged so as to be capable of engaging the second lever 86 only in the counterclockwise direction.

When the scanner 69 is moved from its home position to the left in FIG. 21, the other end 89 of the third lever 88 comes into engagement with the plate cam 73 and is pushed by the plate cam 73, so that the third lever 88 swings the second lever 86 counterclockwise about the support shaft 85. By the counterclockwise swinging of the second lever 86, the first lever 84 is moved to the right in FIG. 21, opening the outlet tube 82 through the control valve 83. At this moment, since compressed air is not generated, air is not jetted from the separation nozzle 64. Further, when the scanner 69 is returned from the left side position shown by the chain line in FIG. 21 to its home position, the plate cam 73 strikes against the lever end position 89. However, the third lever 88 is easily bent to the position shown by the broken line in FIG. 21, and the applied air force is not transmitted to the second and the third lever. Therefore, the control valve 83 is not operated, and the outlet tube 82 is not opened.

Thereafter, when a copy order is given, the scanner 69 is moved from its home position to the left in FIG. 21, and during that forward movement, compressed air is generated through the pump apparatus 66 and is accumulated in the accumulator 81. During the backward movement of the scanner 69 in which it is moved back to its home position, compressed air is accumulated in the accumulator 81 through the pump apparatus 66 on the right side in FIG. 21. This first reciprocal process is for accumulation of compressed air, and even if the registration switch is turned on during this reciprocal process, the registration rollers 16 are not rotated.

The timing of the compressed air being jetted from the separation nozzle 64 will be explained now. When the scanner 69 initiates the second reciprocal process in accordance with the copy order, starting from its home position to the left side in FIG. 21, and the registration switch 90 which is fixed at a predetermined position is turned on through the plate cam 73, the registration rollers 16 begin to rotate, so that the sheet S is fed. When the leading edge of the sheet S comes to the separating position shown by the chain line in FIG. 21, which position is at a distance L from the registration rollers 16, the plate cam 73 of the scanner 69 pushes the end portion 89 of the third lever 88, so that the control valve 83 is operated through the second and first levers, and the outlet tube 82 is opened, allowing compressed air to be jetted from the separation nozzle 64. As a result, air is fed into the gap between the surface of the drum 1 and the leading corner edge Sb shown in FIG. 20.

When the plate cam 73 is moved away from the end portion 89 of the third lever 88 with further continued scanning of the scanner 69, the levers automatically return so as to close the outlet tube 82 again.

When the scanner 69 returns to its home position from the right end portion in FIG. 21, the plate cam 73 strikes against the end portion 89 of the lever 88. However in this case, due to the bending action of the lever 88, the control valve 83 is not operated.

Figure 24:
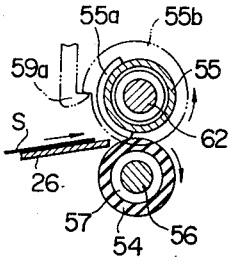
FIG. 24 is a front sectional view of a bending blade roller and an elastic roller, particularly showing their configurations.

Since the apparatus according to the invention is constructed as described above, the sheet S fed from one of the cassettes 13 (FIG. 1) is inserted into the mutual contact portion between the registration rollers 16, guided by the guide plate 26 (FIG. 24) and is caused to be on standby under this condition. Thereafter, at a predetermined time, the rollers 16 can be rotated in the directions of the arrows by the driving system as shown in FIG. 22. When the rollers 16 begin to rotate, the solenoid 58 is energized, whereby the engagement lever 59 is rotated, and engagement projection **59*a* releases the step portion 55*c* of the flange 55*b***.

In accordance with the above-mentioned operation, the bending blade roller 55 is rotated in the same direction as that of the roller **16*b* by the so-called spring clutch mechanism. At this moment, the bending blade 55*a* is brought into pressure contact with the elastic roller 54, with the sheet S held therebetween, and is rotated at the same time. The elastic roller, to which no driving force is applied, is rotated following the rotation of the bending blade 55*a***.

At this time, the leading edge corner of the sheet S is bent so as to be moved away from the surface of the drum 1. More specifically, the dog-eared portion Sb is folded in the shape of a triangle, with a bent line thereon.

When the bending blade roller 55 completes its first rotation, the solenoid 58 is deenergized. As a result, the engagement lever 59 stops the step portion **55*c*, and under this condition, the bending blade roller 55 stopped. In contrast to this, the registration rollers 16 continue to be rotated, and the sheet S having the dog-eared portion Sb is fed towards the drum 1**.

Thereafter, the sheet S comes into contact with the peripheral surface of the drum 1 and is moved together with the drum 1. In the image transfer area A, the visible image formed on the drum 1 is transferred to the sheet S. At this moment, since the dog-eared portion Sb is separated from the surface of the drum 1, no image is transferred to the portion Sb. After image transfer, the sheet S is continuously transported, and its portion Sb receives air jetted from the separation nozzle 64, and is moved away from the surface of the drum 1.

The nozzle 64 jets compressed air against the dog-eared portion Sb, performing separation of the sheet from the surface of the drum 1.

When the separation nozzle is employed as the sheet separation member, it is enough to direct the tip of the nozzle towards the surface of the drum 1. Therefore, it does not occur that the surface of the drum 1 is scratched or damaged by the nozzle. Furthermore, even if the gap between the leading edge corner of the sheet S and the surface of the drum 1 is not constant, compressed air can be projected into the gap, and therefore secure separation of the sheet from the drum surface can be performed.

Furthermore, since the pump apparatus is operated by the scanner, a simple compressed air generation apparatus is sufficient for this purpose. Further, since the pumping action is performed at the termination of the reciprocal operation of the scanner, the pump apparatus serves as a damper for the scanner.

In the above-described embodiments, the bent portion is formed only at the corner of the standard side edge of the sheet. As a matter of course, plural bent portions can be formed in the leading edge of the sheet. In this case, the number of the nozzles should correspond to the number of bent portions in the sheet.

Figure 25:
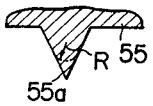
FIG. 25 is an enlarged sectional view of a bending blade.

Furthermore, in the above-described embodiments, a fold is formed conspicuouly in the bent portion Sb. When the bending blade 55*a* is made so as to have a curved edge as shown in FIG. 25, so as to forcibly curl the corner, without making the edge sharp, copies free from such fold can be otained.

Figure 23:
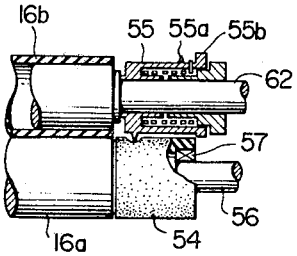
FIG. 23 is a partly cutaway view of the curling means in FIG. 22.

Referring to FIGS. 20 and 23, by constructing the elastic roller 54 so as to be freely rotatable without applying the rotating driving force thereto, the following function can be attained. When the roller 16*b* is made of rubber, its counterpart roller 16*a* is made of metal, for instance. In contrast to this, the elastic roller 54 is made of soft rubber or of sponge rubber. As a result, the coefficient of friction of the roller 54 is greater than that of the metal roller. Under this condition, when the leading edge of the sheet comes into contact with the roller 16*a* and the roller 54, and is then inserted between the registration rollers 16, frictional resistance is formed between the roller 54 and the leading edge of the sheet. Therefore, the leading edge corner of the sheet is delayed in transportation, causing skewing of the sheet. However, since the elastic roller 54 is rotatable, without any resistance on the shaft 56 through the bearing 57, it can be rotated by the above-mentioned frictional resistance, and therefore the skewing of the sheet can be avoided.

Furthermore, the bending blade 55*a* can slightly push into the surface of the elastic roller 54 and has the diameter larger than that of the elastic roller 54. Therefore, the peripheral speed of the bending blade 55*a* is greater than the peripheral speed of the elastic roller 54.

When the roller 16*a* and the elastic roller 54 are constructed integrally, by the difference in peripheral speeds between the roller 54 and the bending blade 55*a*, there is the risk that the bending blade 55*a* slips on the elastic roller 54 and damages it. However, by constructing the roller 54 so as to be freely rotatable, the roller 54 is rotated by the frictional force generated by the blade. Therefore, the above-mentioned slip or the damage of the roller 54 can be entirely eliminated.

What is claimed is:

1. In an apparatus for transporting a sheet along a path into close contact with a surface of a member moving synchronously with said sheet, and thereafter separating the sheet from said surface, the improvement comprising:

bending means including a pressure-application device having a catching portion normally located along said path and adapted to engage at least a part of the leading edge of said sheet for pivoting said pressure-application device by further movement of said sheet along said path to thrust a second portion of said device from a normal position into a bending position engaging said sheet to bend a leading corner portion of said sheet upwardly so that it will lie away from said member, and stripping means located adjacent said member for forcing said bent corner portion of said leading edge in a direction away from said surface.

2. An apparatus according to claim 1, said bending means including an elastic member disposed along said transportation path for said sheet and having a surface driven for rotation in the same direction as the transportation direction of said sheet, said catching portion being disposed in the transportation path of said sheet for engaging the leading edge of said sheet transported therealong, and said second portion being normally held upstream of said catching portion at a location outside of said sheet transportation path and in confronting relation to said elastic member.

3. An apparatus according to claim 1, including means holding said pressure-application device rotatably in position.

4. An apparatus according to claim 1, said bending means further including means for returning said catching portion and said second portion to their normal positions after a corner portion of said sheet is bent upwardly.

5. An apparatus according to claim 4, wherein said returning means pivots said catching portion and said second portion in the same general direction as the transportation direction of said sheet for returning them to their normal positions.

6. An apparatus according to claim 1, including a plurality of said pressure-application devices disposed around a common rotatable shaft.

7. An apparatus according to claim 6, further including detent means for rotating each said pressure-application device through a predetermined angle at the passage of each of said sheets to position said pressure-application devices in their normal operative position in succession and holding them in said position until the passage of the next sheet.

8. An apparatus according to claim 7, said detent means including a shaft polygonal in section and having the same number of sides as the number of said pressure-application devices, and a plate spring engaging said polygonal shaft for holding it in position.

9. An apparatus according to claim 1, said second portion being formed from a hard material.

10. An apparatus according to claim 1, further including means including a arcuate guide portion located to guide the leading edge of a sheet leaving said bending means to lead said sheet to said member.

11. An apparatus according to claim 10, said guide portion being disposed along a side edge of the sheet guided thereby.

12. An apparatus according to claim 10, said guide portion being formed of a resilient material, and adapted to lie in proimity to a side portion of said member, and means for flexing said guide member away from said member.

13. An apparatus according to claim 1, said stripping means including a pawl located in the path of movement of said bent corner portion of said leading edge.

14. An apparatus according to claim 1, said stripping means including a nozzle located near the path of movement of said bent corner portion for directing compressed air beneath said bent corner portion, and means for supply compressed air to said nozzle.

15. In an apparatus for reproducing images, including an image-bearing member adapted to carry an image on a surface thereof, said surface being adapted to move continuously in a predetermined direction, means for transporting a sheet along a path synchronously with movement of said surface to bring it into close contact with said surface, means for transferring said image born by said surface to said sheet, and means for separating said sheet after transfer of said image from said surface, the improvement comprising:

bending means including a pressure-application device having a catching portion normally located along said path and adapted to engage at least a part of the leading edge of said sheet for pivoting said pressure-application device by further movement of said sheet along said path to thrust a second portion of said device from a normal position into a bending position engaging said sheet to bend a leading corner portion of said sheet upwardly so that it will lie away from said member, and stripping means located adjacent said member for forcing said bent corner portion of said leading edge in a direction away from said surface.

16. An image reproducing apparatus according to claim 15, said image being born on said surface being a visible toner image, and said transferring means including a corona charger.

17. An image reproducing apparatus according to claim 15, said bending means including an elastic member disposed along said transportation path for said sheet and having a surface driven for rotation in the same direction as the transportation direction of said sheet, said catching portion being disposed in the transportation path of said sheet for engaging the leading edge of said sheet transported therealong, and said second portion being normally held upstream of said catching portion at a location outside of said sheet transportation path and in confronting relation to said elastic member.

18. An image reproducing apparatus according to claim 15, including means holding said pressure-application device rotatably in position.

19. An image reproducing apparatus according to claim 15, said bending means further including means for returning said catching portion and said second portion to their normal positions after a corner portion of said sheet is bent upwardly.

20. An image reproducing apparatus according to claim 19, wherein said returning means pivots said catching portion and said second portion in the same general direction as the transportation direction of said sheet for returning them to their normal positions.

21. An image reproducing apparatus according to claim 15, including a plurality of said pressure-application devices disposed around a common rotatable shaft.

22. An image reproducing apparatus according to claim 21, further including detent means for rotating each said pressure-application device through a predetermined angle at the passage of each of said sheets to position said pressure-application devices in their normal operative position in succession and holding them in said position until the passage of the next sheet.

23. An image reproducing apparatus according to claim 22, said detent means including a shaft polygonal in section and having the same number of sides as the number of said pressure-application devices, and a plate spring engaging said polygonal shaft for holding it in position.

24. An image reproducing apparatus according to claim 15, said second portion being formed from a hard material.

25. An image reproducing apparatus according to claim 15, further including means including a arcuate guide portion located to guide the leading edge of a sheet leaving said bending means to lead said sheet to said member.

26. An image reproducing apparatus according to claim 25, said guide portion being disposed along a side edge of the sheet guided thereby.

27. Am image reproducing apparatus according to claim 25, said guide portion being formed of a resilient material, and adapted to lie in proximity to a side portion of said member, and means for flexing said guide member away from said member.

28. An image reproducing apparatus according to claim 15, said stripping means including a pawl located in the path of movement of said bent corner portion of said leading edge.

29. An image reproducing apparatus according to claim 28, wherein said stripping pawl is held in light contact with said surface.

30. An image reproducing apparatus according to claim 28, wherein said stripping pawl is spaced from said surface in close proximity thereto.

31. An image reproducing apparatus according to claim 15, said stripping means including a nozzle located near the path of movement of said bent corner portion for directing compressed air beneath said bent corner portion, and means for supply compressed air to said nozzle.

32. An image reproducing apparatus according to claim 31, further including scanning means including a optic system for projecting an image onto said surface, said scanning means serving to actuate said compressed air supply means.

* * * * *